United States Patent [19]

Kohler et al.

[11] 4,084,860

[45] Apr. 18, 1978

[54] APPARATUS FOR MOUNTING AN OPEN END SPINNING TURBINE

[75] Inventors: Gisbert Kohler, Offingen, Hanns-Wilfried Munkel, Stuttgart; Hubert Pohl, Waiblingen, Walter Sommer, Leonberg, Gunther Wendel, Stuttgart, all of Germany

[73] Assignee: SKF Kugellagerfabriken GmbH, Schweinfurt, Germany

[21] Appl. No.: 689,962

[22] Filed: May 26, 1976

[30] Foreign Application Priority Data

May 31, 1975 Germany ..... 2524231

[51] Int. Cl.[2] ..... F16C 3/00; F16C 35/00

[52] U.S. Cl. ..... 308/15; 308/DIG. 15

[58] Field of Search ..... 308/DIG. 15, 78, 149, 308/150, 15, 26, 37, 21

[56] References Cited

U.S. PATENT DOCUMENTS

| | | | |
|---|---|---|---|
| 3,494,678 | 2/1970 | Reznick et al. | 308/184 |
| 3,897,985 | 8/1975 | Davis et al. | 308/184 R |
| 4,021,086 | 5/1977 | Rajsigl | 308/DIG. 15 |

*Primary Examiner*—Richard A. Bertsch

[57] ABSTRACT

Apparatus for mounting an open end spinning turbine positioned adjacent the front end of a drive shaft includes a bearing block which has a pair of spaced walls traversed by the drive shaft. Rollers are provided between the spaced walls forming a V-groove support for the drive shaft. The rear end of the shaft extends outwardly of the rear wall of the bearing block and has an annular T-slot formed therein. A bushing is mounted in the wall for journalling of the shaft, and a guide member extends within the T-slot for establishing the axial location of the shaft within the supporting rollers.

26 Claims, 11 Drawing Figures

APPARATUS FOR MOUNTING AN OPEN END SPINNING TURBINE

Figure 1:
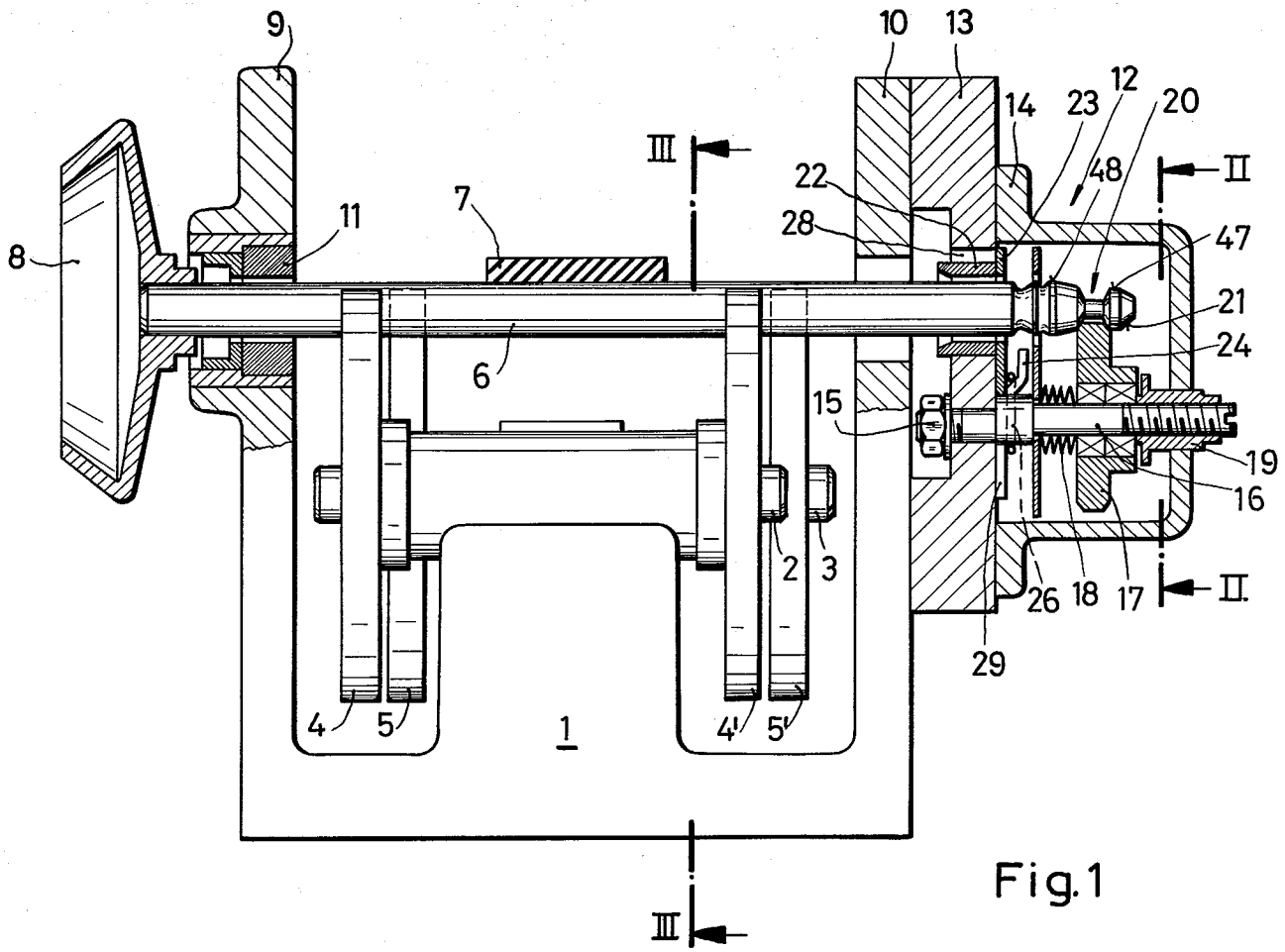

A known bearing device for the shaft of an open-end-spinning turbine, consists of two pairs of support rollers, forming a V-groove in which the shaft is directly supported, the shaft being axially fixed by a radial edge of a rotating body, intruding into an annular gap formed by two rings which are fastened to the shaft at a distance from each other, the rotational body being journalled in its position axially parallel to the shaft in a housing which is separated from the pair of support rollers by a wall which is traversed by the shaft and which contains a reservoir of lubricating oil (DT-OS No. 2,203,586). The insertion into and the withdrawal out of its axial position requires assembly steps even when the shaft is not, as in the abovedescribed case, simultaneously the carrier of a rotor, encircled by the stationary stator of an electromotor, but also when the shaft is driven by a tangential belt abutting it, because the rings affixed to the shaft alone would prevent the movement of the shaft through the aperture in the housing wall which the shaft traverses.

The present invention endeavors therefore to alleviate these difficulties by providing in a simple manner a device of the aforementioned kind wherein the inserting into and the withdrawal out of the bearing mechanism is possible without a tool but simultaneously its axial securement is obtained without needing any particular manipulations to perform.

It is now possible to bring into the axial fixed position the turbine shaft which rests in the V-groove or to remove it from this position by simple correspondingly axial shifting wherein only the force which is actuated by a spring action upon the bushing and/or the rotating body has to be overcome. The bushing which is associated with the turbine shaft within the area of its traverse through the separating wall secures the position of the turbine shaft within the V-groove; it also aids in preventing leakage of lubricating means contained in the area of the axial fixing means into the area of the V-groove, and it also may serve as a support means for a turbine shaft which is provided with a braking mechanism, which upon braking tends to lift the shaft out of the V-groove. The bushing may in its inner diameter be so dimensioned that between it and the turbine shaft only a steady slide contact occurs, it can also be dimensioned so that it surrounds the shaft, lying in the V-groove, with an airgap and that mutual contact occurs only when inserting or removing the shaft from or out of axial securement and by an eventual braking. Instead of a bushing which surrounds the turbine shaft, the aforementioned securing- and support-functions may be also fulfilled by employing a cup-shaped part, which embraces only partially the circumference of the shaft.

Advantageous modifications of the present invention are also described. Particular advantages of these modifications are mentioned in the description of the drawings.

Figure 2:
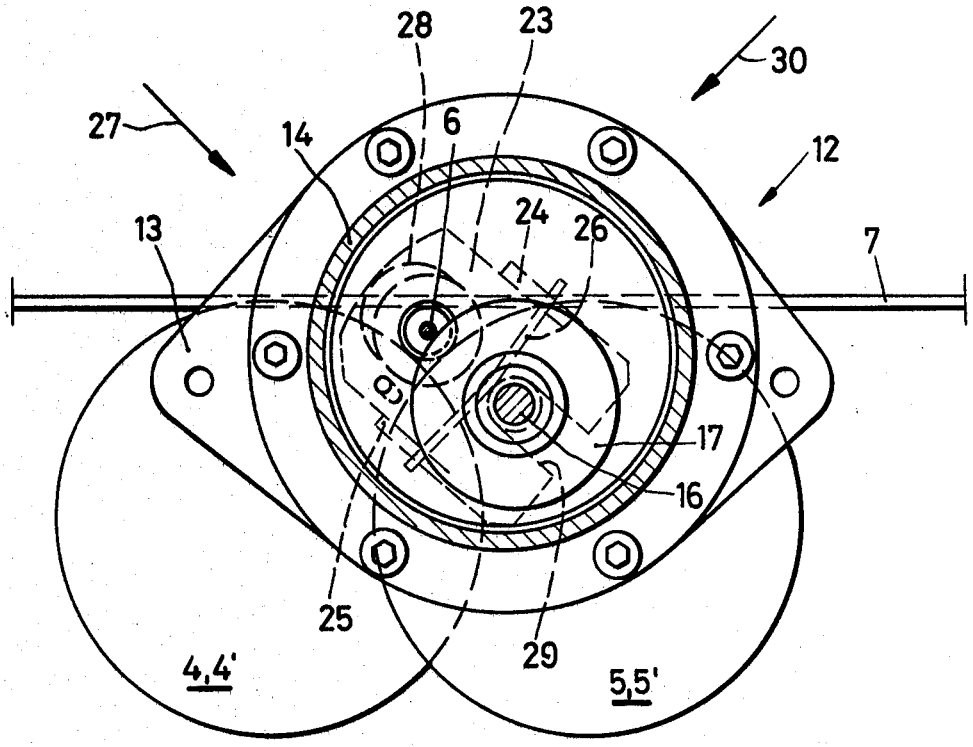
Figure 3:
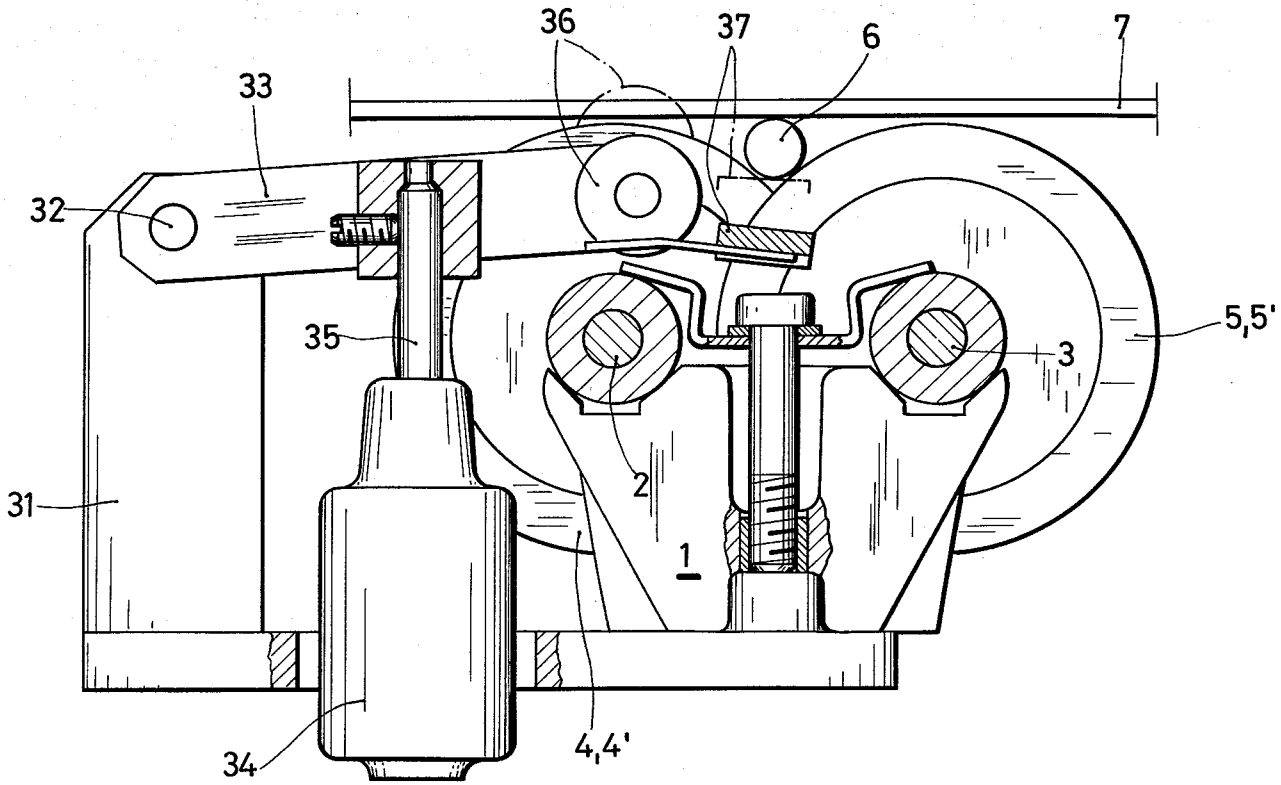
Figure 4:
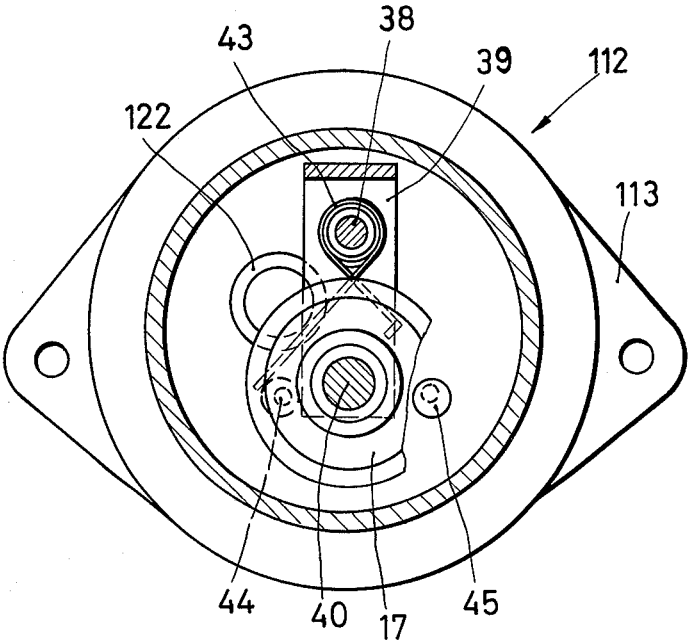
Figure 5:
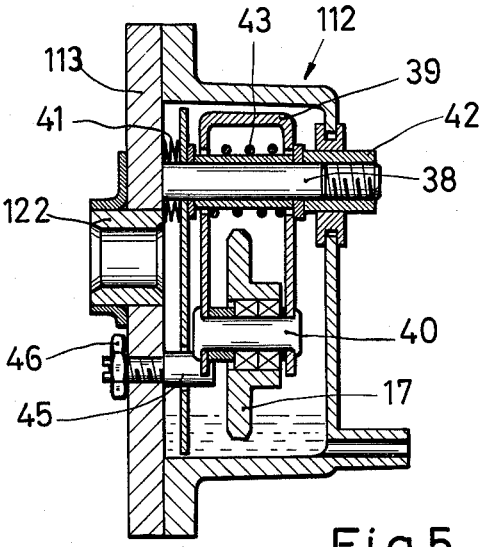

The invention will be illustrated by the drawings. They show:

FIG. 1 a bearing mechanism in side elevation, partly in section;

FIG. 2 a view along the section line II—II in FIG. 1;

FIG. 3 a view of a braking mechanism associated to the device according to FIGS. 1 and 2, the section is drawn along the line III—III in FIG. 1;

FIG. 4 a view of a second example of a device for the axial fixation of a turbine shaft;

FIG. 5 the device according to FIG. 4 in in side sectional elevation

Figure 6:
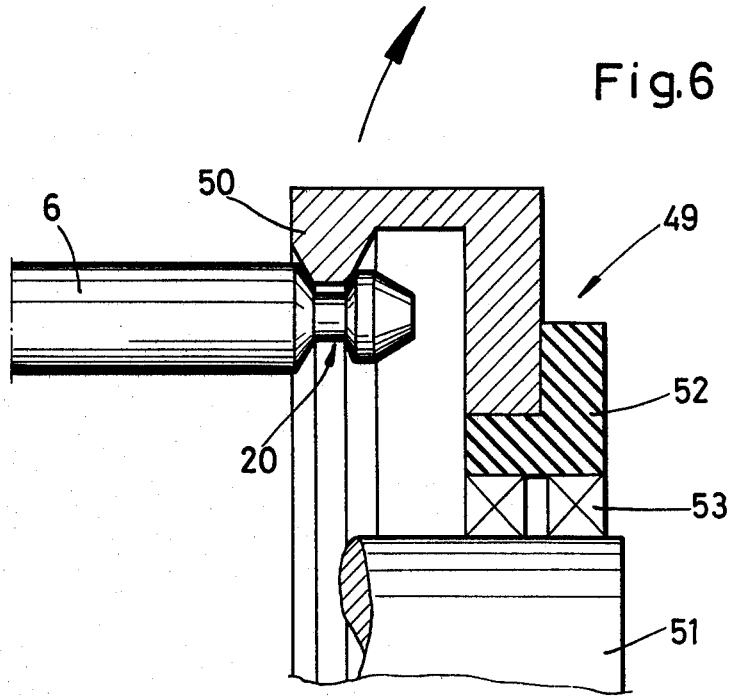
Figure 7:
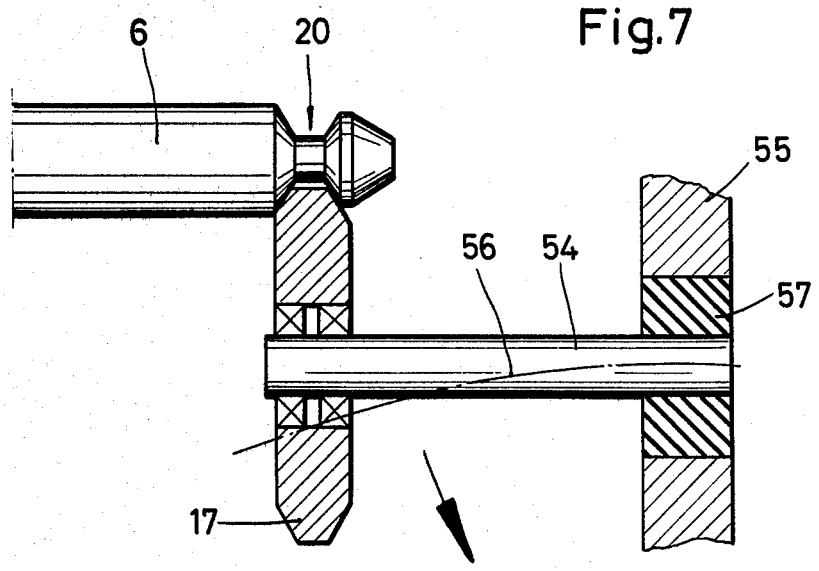
Figure 8:
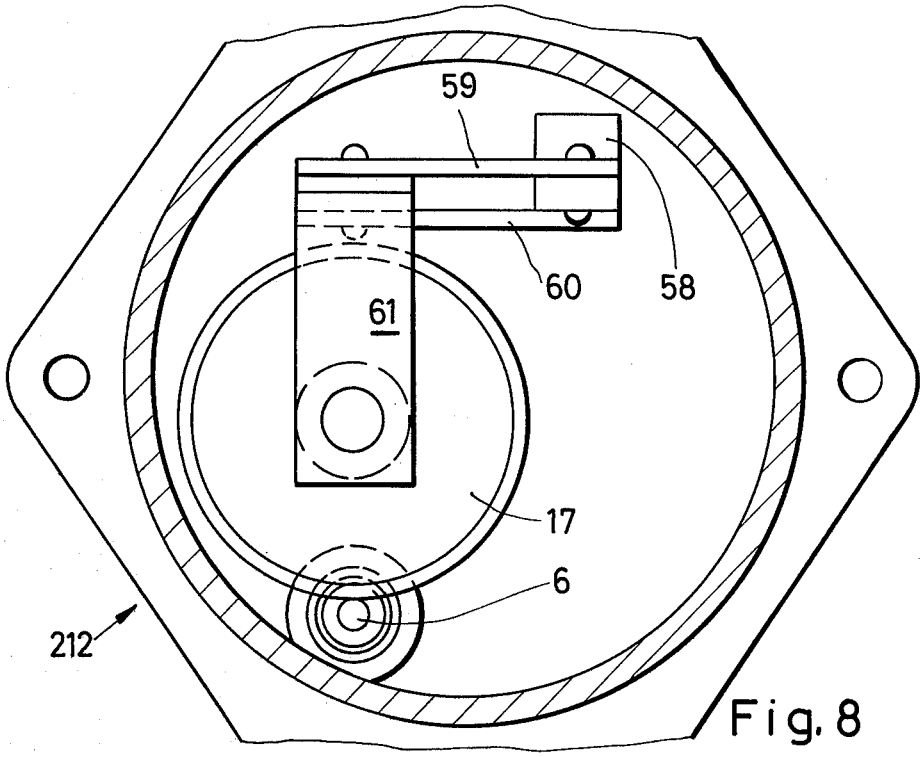
Figure 9:
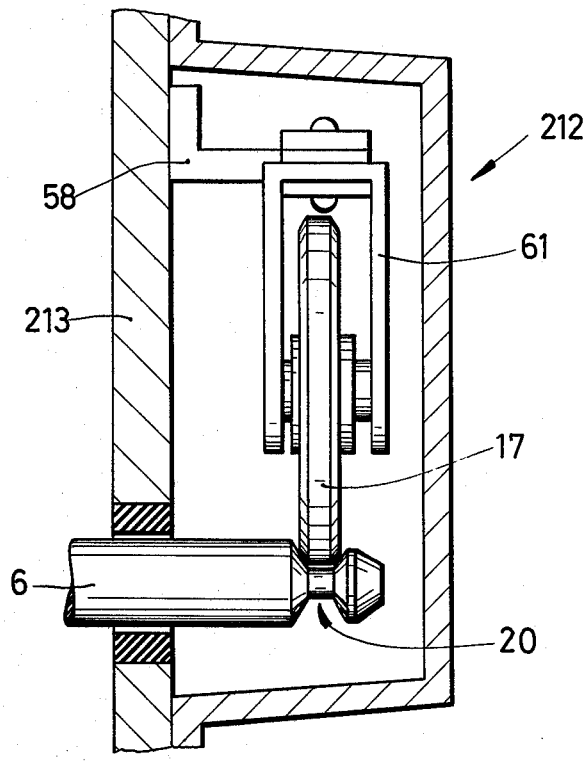
Figures 10, 11:
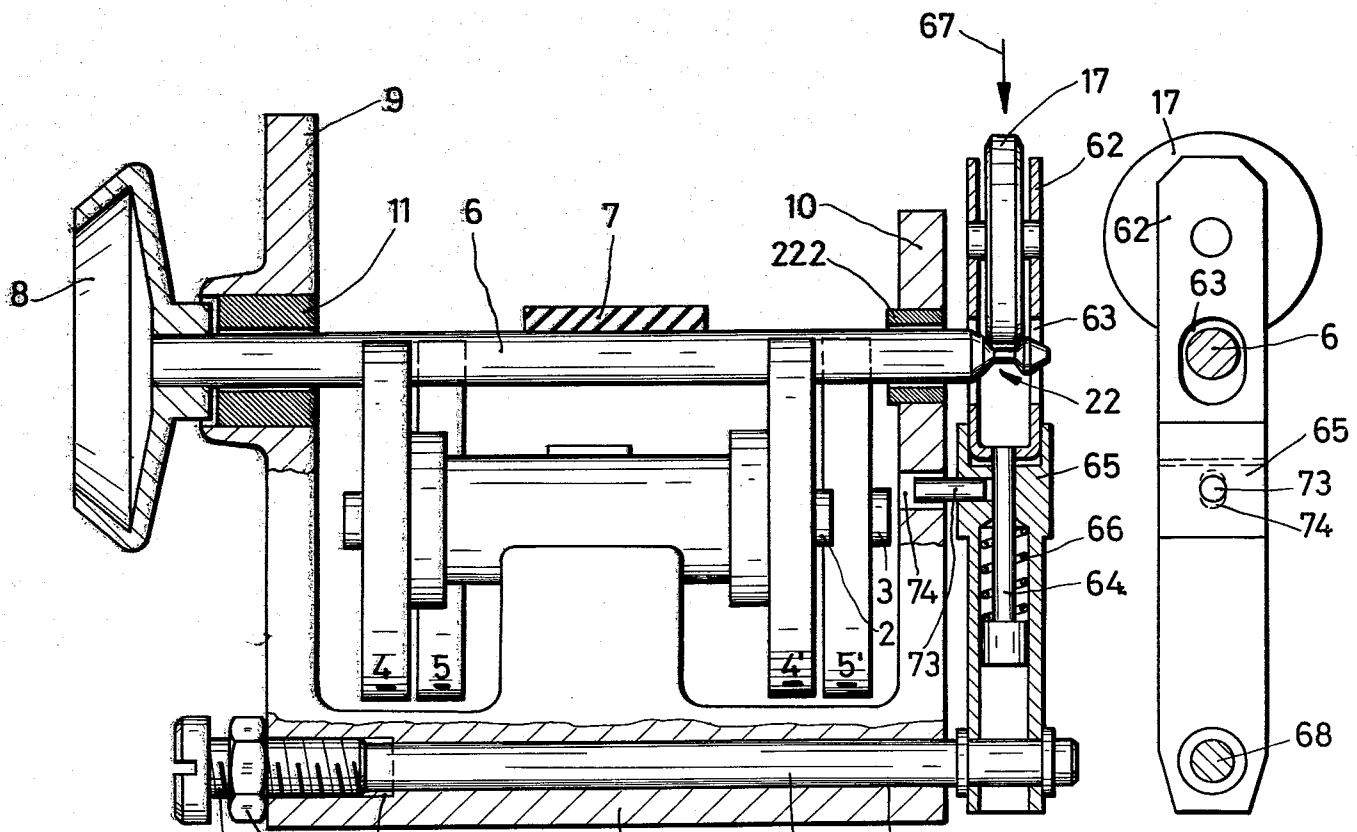

FIG. 6 side elevation of the endpiece of the turbine-shaft with an elastically formed axial fixing member;

FIG. 7 side elevation of the endpiece of the turbine shaft with an axial fixing member, held upon an elastic carrier;

FIG. 8 view of another, differently shaped elastically formed carrier for an axial fixing member;

FIG. 9 a sideview to FIG. 8;

FIG. 10 sideview of an axial fixing device which may be adjusted from the side of the spinning turbine;

FIG. 11 a rearview of the axial fixing member according to FIG. 10.

In FIG. 1, 1 indicates a bearing block upon which two bearing housings are secured in which shafts 2 and 3 are held respectively. The shafts carry support rolls 4,4' and 5,5' and both pairs of support rolls are, as may be seen in FIGS. 2 and 3, arranged in such a way in relation to each other that a V-groove is formed between them for bearing the shaft 6 onto which abuts a tangential drive belt 7. A spinning turbine 8 of an open-endspinning device is affixed at one end of the shaft 6. The shaft 6 traverses the spaced walls 9 and 10 of the bearing block 1. In the wall 9 a bushing 11 is fastened, which is so dimensioned and arranged that it encircles the shaft 6 which rests in the V-groove with an airgap and without touching it. On the wall 10, by means of for example not shown screws, is secured an enclosure generally denoted by 12 in which is located the axial positioning means, having an endpiece which intrudes into engagement with the shaft 6.

The enclosure 12 is formed by a baseplate 13 and a cap 14, which is detachably fastened to it. In the baseplate 13 is fastened by a nut 15, screwed onto one of its threaded pins, a journal lug 16 for a rotational body, shaped like a rotor disk 17. Because the threaded pin is eccentrically arranged in relation to the journal lug 16, it follows that the journal lug 16 and thus the rotor disk 17 may be given a radial position which may be regulated and locked in position in relation to the shaft 6. Furthermore the rotor disk 17 is held axially locked and regulated onto the journal lug 16 by being, on the one hand, held upon cup springs which are set upon the lug and, on the other hand, by being held upon a locknut 19 which is screwed onto another threaded pin of the journal lug.

The rotor disk 17 engages with its circumferential rim an annular T-slot cut into the shaft 6 close to its end and thereby fixes the axial position of the shaft 6 within the V-groove.

As shown, the sideplanes which limit the annular T-slot 20 are at both sides bevelled so that they widen the slot, as also in a similarly adapted manner the rim parts of the rotor disk 17 so that the shaft 6 and the rotor disk 17 touch each other only in the area of their flanks, whereby the degree of contact may be determined by the mentioned possibility of a radial setting of the rotor disk 17 in relation to the shaft 6.

As shown, the free frontal plane of the shaft 6 is provided with a bevel 21 so that the shaft may appear chamfered. This bevel 21 and the vicinal side of the annular T-slot 20 render it possible that, on axial pushing or pulling of the shaft in or out of its position respectively, the shaft 6 may slide with its bevelled sides over the rim of the stationary rotor disk 17; this also can occur when the rotor disk is not provided with a bevelled part of its rim. Due to this sliding over the rim of the rotor disk, a proportional lifting of the shaft out of the V-groove between the support rolls 4', 5' results.

The shaft 6 is provided in the area of its penetration through the baseplate 13 with an encircling bushing 22. This bushing may encircle the shaft tightly to assure that the shaft is not lifted radially out of the V-groove, e.g. for shut-down, the belt 7 is lifted off the shaft 6. The bushing 22 may also additionally, as suggested in the drawing, encircle the shaft with an airgap at a distance. In order to be also capable of participation in the insignificant lifting-out movement of the shaft 6, mentioned to occur while pushing in and pulling out of the T-slot, the bushing 22 is fastened upon a, in relation to the shaft 6, radially movable support, which is, as particularly seen in FIG. 2, formed as a to and fro fulcrumed slidebar 23. From the slidebar 23 are bent off on both sides the flaps 24 and 25, which are engaged at their other end by a spring 26, laid around the journal lug 16, which tends to push the slidebar 23 in the direction of the arrow 27 in FIG. 2. This motion is limited by the bushing 22 which penetrates the groundplate 13 through an oblong slot 28, coming to rest at the end of this slot 28. A straight motion of the slidebar results from providing the slidebar 23 with an oblong slot 29, which opens preferably on one side, which leads it also along the journal lug 16.

This path of motion of the slidebar 23, denoted by the arrow 27 (FIG.2) runs preferably in the direction of a tangent, drawn onto the support disk at the point of contact between the shaft, resting in the V-groove, and a support disk. In the example shown, as discernible in FIG. 2, the slidebar 23 is guided tangentially to the supporting disks 4, 4'.

The slidebar 23 could be, basically, guided along any other path which lies between the one tangent, marked by the arrow 27 and the other tangent marked by 30, which is drawn onto the support rolls 5,5' at the point of contact between the rolls and the shaft 6. But the tangentially progressing path of motion of the slidebar 23 has particular advantages when the shaft 6 is furnished with a brake mechanism, whereby, when braking, a force is applied which loosens the shaft from the support rolls; thus it is a force which tends to push the shaft out of the V-groove.

Such a braking mechanism is shown in FIG. 3.

On bearing bracket 31, connected to bearing block 1 in a swivel bearing 32, is held a brake lever 33 which is adjustably connected to a piston rod 35 to and fro displaceable in a compressed air cylinder housing 34. At the free end of the brake lever 33 are journalled a lift-off roll 36, associated with the tangential drivebelt 7 and a brakeshoe, associated with the turbineshaft 6. When a movement of the piston rod 35 swivels the brakelever 33, the lift-off roll 36 removes the belt 7 from the shaft 6 and also the brakeshoe 37 abuts brakingly the shaft 6, as shown in the dot-dashed suggested positions of the parts 36 and 37. In the enclosing bushing 11 and 22, the shaft 6 finds its counter support whereby, if these bushings surround the shaft 6, as shown in FIG. 1, with an airgap, the shaft 6 may be lifted far out of the V-groove. The danger that the force which acts upon the shaft 6 also moves the bushing 22 with the slidebar 23 against the force of the spring 26 and thereby loosens the engagement of the rotor disk 17 and the annular T-slot 20 or even removes the engagement altogether, thus lowering or cancelling the axial fixing of the shaft 6, is optimally prevented by the tangential guidance of the slidebar 23, as explained in FIG. 2, because the braking force acting upon the shaft 6 can result only in a minimal displacing force upon the slidebar 23. This force can be only counteracted by a proportionally large force of the spring 26 so that non-movement of the slidebar during the braking action is assured.

The association of the lift-off roll 36, as seen in FIG. 3, with the pair of supporting disks 4,4', in other words to those to which the slidebar 23 is tangentially guided, has the particular advantage, that, while the belt 7 is removed by the lift-off roll and the pushing and pulling of the shaft 6 occurs in and out of the V-groove, respectively, the shaft can move sideways according to the path of the slidebar within the space out of which the tangential belt 7 is the remove, thus not impeding the movements of the shaft 6.

The description of the following Figures will show that even when the bushing is solidly disposed in the dividing wall, by axial displacement only of the shaft, its axial fixing in the annular T-slot may be actuated or released.

The FIGS. 4 and 5 show an enclosure, generally marked 112, which is fastened like the enclosure 12 in the aforedescribed example to the wall 10 of the bearing block 1 and which may also be associated with the turbine shaft 6 which rests in the V-groove. Fastened in the baseplate 113 are the bushing 122 and a journal 38. The journal 38 forms a bearing for a U-shaped bracket 39 onto which, near the ends of its free legs closing the U-shape, a bearing axle for the rotor disk 17 is fastened. The bracket 39 is axially adjustable and held onto the journal 38 by, on the one hand, abutting the cupsprings 41, seated upon the journal, and on the other hand, by a setscrew 42 which may be screwed onto a threaded projection of the journal 38. A legspring 43, encircling the journal 38, tends to swivel the bracket 39 clockwise, as shown in the drawing FIG. 4. This swivelling motion is limited by a backing-off bolt 44, while an opposite swivelling motion is limited after a short swivelling by a similar backing-off bolt 45. Both backing-off bolts are adjustably affixed in the baseplate 113 by being capable of being locked into the desired rotary setting position by an eccentrically thread projection penetrating the plate 113 and a nut 46 screwed onto it.

By a corresponding setting of the backing-off bolt 44, the swivel motion of the bracket 39 is limited in a position in which the rotor disk 17, as seen in FIG. 4, protrudes only that far into the path of the shaft 6, which penetrates the bushing 122, that the bevel 21, formed at its free frontal plane, (FIG. 1) at its meeting with the rim of the rotor disk 17, can push this disk, while respectively swivelling the bracket 39, out of the of the path of insertion of the shaft 6. Thereafter the rotordisk 17 may, due to the force of the legspring 43 which swivels back the bracket 39, drop into the annular T-slot 20 of the shaft 6 and is now capable of fixing the axial direction of shaft 6.

The backing-off bolt 45 is set, so that it limits the swivelling of the support 39 shortly beyond that swivel position which it reaches when, on insertion of the shaft 6, the rotordisk 17 slides over the shaft segment 47 (FIG. 1) which lies between the bevel 21, at the frontal side of the shaft 6 and the annular T-slot 20. The other edge plane of the annular T-slot, leading from it upwards to the middle of the shaft, leads towards a segment of the shaft 48 having a larger diameter than the shaft segment 47 has. Thus even if accidentally, e.g. by too strong an insertion motion, the shaft 6 is moved beyond its axial fixing position and thereby the shaft 6, with its bevel which leads upwards from the annular T-slot 20 to the segment 48 slides upward upon the rotor disk 17, according to FIGS. 4 and 5, the swivelling motion of the bracket 39 is limited by the backing-off bolt 45 before the shaft 6 slides up the segment 48 upon the rotor disk 17. Thereby the insertion motion of the shaft 6 into the housing is limited. The method of giving the shaft in the area between the T-slot 20 and its free frontal plane a smaller diameter than in the area on the other side of the T-slot 20, in other words to form the shaft segments 47 and 48 with different diameters prevents in cooperation with the backing-off bolt 45 any damages caused by the improper insertion of the shaft 6.

The journal lug 38 may be fastened just like the journal lug 16, according to FIG. 1, so as to be adjustable radially towards the shaft 6 and fixable in the base plate 13, so that a radial adjustment of the support 39 is possible in relation to the shaft 6.

FIG. 6 shows a cup-shaped rotary body 49, which engages by a flange 50, formed on the inner rim of the cup, the annular T-slot 20 of the turbine shaft 6 and thereby actuates the radial positioning of the shaft 6. The rotary body 49 journals upon an axle 51 which is solidly connected to the bearing block of the bearing device and rests solidly upon a roller bearing 53 under intercalation of a ring-shaped part 52 prepared from an elastic material. By this degree of elasticity given the rotary body 49, it can move away in the direction, suggested by the arrow, at the axial insertion and extraction of the shaft 6.

FIG. 7 shows a rotor disk 17, in engagement with the annular T-slot 20 of the shaft 6, thus causing the axial positioning. The rotor disk 17 journals upon an elastic support, formed as a springrod 54, which is fastened to a wall 55, solidly connected to the bearing block of the bearing device. Due to its self-elasticity, the springriod 54 and consequently the rotor disk 17 are capable of giving way on axial insertion and extraction of the shaft 6, as shown by the dot-dashed path of the center axis 56 of the spring rod 54. The springrod may, as shown, be fastened unto the wall 55 also by intercalating a part 57 consisting of an elastic material.

FIGS. 8 and 9 show also a substantially elastic support of a rotordisk 17 which causes by it engagement with the annular T-slot 20 the axial fixing of the shaft 6 and is such that it may give way in case of its axial deflection. The maintenance-free spring joint consists of a wall bracket 58, fastened to the baseplate 213 of the enclosure 212. Two leafsprings 59, 60 are fastened at the one end to bracket 58 and their other ends to a holder 61 in which is journalled the rotordisk 17. This arrangement ensures a particularly advantageous stability of the rotordisk 17 within the direction of the axis of the shaft 6, and thus its secure axial positioning. The rotordisk 17 may be fastened so as to be axially adjustable and lockable in the holder 61 in order to define exactly the position of the shaft 6.

In the bearing device, shown in FIGS. 10 and 11, the holder which determines the axial fixing of the turbine-shaft is disposed adjustably and lockably within the direction of the axis of the shaft, in order to exactly determine the position of the shaft. The construction is disposed in such a manner that the adjustment- and fixing- means are easily reached from the side of the shaft which carries the spring machine, by hand, so that the adjustments may be performed from the side.

The shaft 6, journalled in the V-groove between the support rollers 4,4', 5,5' and driven by the tangential belt 7, penetrates the bushings 11 and 222, respectively, which are fastened to the walls 9 and 10 of the bearing block 1. The annular T-slot 22 of the shaft 6 engages the rotor disk 17 which is journalled pivotably in a holder 62 which forms a part of a support. The holder 62 contains an aperture 63, enabling the shaft 6 to penetrate it, and is slidably guided by a piston-shaped rod 64, which is fastened to holder 62, in a support housing 65 forming the other part of the support. A compressionspring 66, conformingly encircling the rod 64, tends to move the holder 62 in the direction of the arrow 67 towards the support housing 65. Walls projecting upwards from the support housing 65 abut the lower area of the holder 62 and form a protection for both parts against twisting against each other. The support housing 65 rests against one end of a holding rod 68 which rests in a borehole 69, which is drilled into the bearing block 1 axially parallel to the shafts 2 and 3 of the support rollers and engages with its threaded projection a counterthreaded piece 71 of the borehole 69. By a corresponding screwing-in depth of the holding rod 68 in the counterthreaded piece 71, the position of both parts 62 and 65, forming the holder of the rotary disk 17, can be determined, and thus the locus where the rotary disk 17 by its engagement with the annular T-slot 22 axially fixes the shaft 6. The adjusting position of the holding rod 68 is secured by a locknut 72, which is screwed onto its threaded part 70 abutting the bearing block. Against participation in the rotary motions of the holding rod 68, the holder is secured by a locking pin 73 which engages a recess 74, adapted to it, of the bearing block wall 10/.

By overcoming the power of the compression spring 66 the engagement of the rotary disk 17 with the annular T-slot 20 is released.

As in all other aforedescribed Figures, the force of the spring which presses the rotary body into the annular T-slot 20 must, of course, be adjusted so that it cannot be overcome by the axial forces which arise from the movement of the shaft, i.e. while the device is running; but, on the other hand, it should be not so large that the introduction and the withdrawal of the shaft 6 becomes too cumbersome.

Considering the high number of rotations during the running of the shaft, a sufficient supply of lubricant must be supplied for the area of engagement of the annular T-slot and the rotary body. In FIG. 5 it is suggested that the enclosure 112 contain a lubricant supplying into which the rim area of the rotary disk 17 constantly dips.

We claim:

1. Apparatus for mounting an open end spinning turbine located at the front end of a drive shaft and having means for rotating said drive shaft, comprising a bearing block having a pair of spaced walls transversed by said drive shaft and roller means located between said walls forming a V groove support for said drive shaft, the rear end of said shaft extending outwardly of the rear wall of said bearing block and having an annular T-slot formed therein, a bushing mounted in said wall for journalling said shaft and a guide member extending within said T-slot to thereby fix the axial position of said shaft within said supporting roller means.

2. The apparatus of claim 1, including means for normally biasing said guide member into resilient engagement with said annular T-slot, and permitting displacement of said guide member therefrom 3. The apparatus according to claim 2, wherein said guide member comprises a roller mounted about an axis normally parallel to said shaft.

4. The apparatus according to claim 3, wherein said roller is mounted eccentrically to its axis and is rotatably adjustable to vary the distance between it and said shaft.

5. The apparatus of claim 1, wherein said drive shaft has a larger diameter in that portion extending from said turbine to said annular T-slot than in that portion between said annular T-slot and the end thereof.

6. The apparatus of claim 1, wherein the engaging edges of said annular T-slot and said guide member are beveled.

7. The apparatus according to claim 1, including an adjustable buffer to limit movement of said guide member in the direction towards the shaft.

8. The apparatus according to claim 1, including an adjustable buffer to limit movement of said guide member in the direction away from the shaft.

9. The apparatus according to claim 1, including a housing mounted on the wall enclose at least said guide member.

10. The apparatus according to claim 1, including seal means for sealing said housing and a lubricant contained therein.

11. The apparatus according to claim 1, wherein said bushing and said guide member are fastened upon a movable support which enables the displacement relative to said drive shaft.

12. The apparatus of claim 11, wherein said support comprises a movable slide bar mounted in said housing.

13. The apparatus according to claim 11, wherein said support is movable to move said slide bar in a plane perpendicular to the axes of the V-groove roller means in a path comprising the tangent to the point of contact of said shaft and the V groove.

14. The apparatus according to claim 11, wherein said drive means comprises a tangential belt having means for lifting the belt from said shaft, said lift-off mmeans being arranged in the area of the V groove rollers at which said slide bar is tangentially displaceable.

15. The apparatus according to claim 11, wherein said bushing is disposed in an oblong slot in the wall, and said slide bar is provided with an oblong slot straddling a lug fastened to said wall, thereby defining said tangential movement.

16. The apparatus according to claim 13, wherein the guide member is axially adjustably journalled upon the lug.

17. The apparatus according to claim 13, including means for fixing said guide body on said lug relative to said shaft.

18. The apparatus according to claim 15, wherein said fixing means comprises a locknut mounted upon a thread-extension of the lug and a compression spring encircling the lug supported at its other end by a collar formed on said lug.

19. The apparatus according to claim 1, wherein said guide member is mounted on an arm journalled at one end to swing about an axle parallel to said shaft.

20. The apparatus according to claim 19, wherein said arm comprises a U-shaped bracket having near the ends of its free legs a bearing axle for said guide member.

21. The apparatus according to claim 19, including means for axially adjusting said arm along its swivel axle.

22. The apparatus according to claim 1, wherein said roller is journalled on an axle pivotally mounted at one end to be movable with respect to said shaft to permit said roller to move into and out of engagement with said T-slot.

23. The apparatus according to claim 1, wherein said guide member comprises an arm having an arcuate collar at one end adapted to engage within said T-slot, said arm being resiliently mounted at the other end permitting said flange to move into and out of engagement with said T-slot.

24. The apparatus according to claim 1, wherein said guide member is mounted on a support fastened onto the handrail for the V groove roller, said handrail being adjustably secured in the direction of the shaft axis, and including a mechanism capable of being reached by hand from the side of the shaft which carries the spinning turbine.

25. The apparatus according to claim 24, wherein said support comprises two parts, one of which is fastened unto the handrail, the other of which journals said guide member and is radially movable relative to the shaft and includes spring means interposed between said parts to bias said guide member in the direction towards the shaft.

26. The apparatus according to claim 1, wherein said guide member is mounted on a bracket, secured to said wall by a spring.

* * * * *